United States Patent [19]

Tessler et al.

[11] Patent Number: 4,503,687

[45] Date of Patent: Mar. 12, 1985

[54] MEANS FOR AND PROCESSES OF MOUNTING GEM STONE CLUSTERS

[76] Inventors: Moshe Tessler, 626 Wythe Pl., Apt. 5E; Chaim Silberman, 571 Wythe Pl., both of Brooklyn, N.Y. 11211; Richard Zollman, 158 Belgielei, 2000 Antwerpen, Belgium

[21] Appl. No.: 354,776

[22] Filed: Mar. 10, 1982

[51] Int. Cl.[3] ..... A44C 17/02; B22C 7/02

[52] U.S. Cl. ..... 63/28; 29/160.6; 434/81

[58] Field of Search ..... 63/20, 23, 29 R, 27, 63/28; 29/160.6, 511; 434/81, 369, 386

[56] References Cited

U.S. PATENT DOCUMENTS

| | | | |
|---|---|---|---|
| 775,030 | 11/1904 | Fairbrother | 63/28 |
| 795,109 | 7/1905 | Dover | 29/160.6 X |
| 1,001,377 | 8/1911 | Fairbrother | 63/28 |
| 3,255,611 | 6/1966 | Doherty | 434/81 |

FOREIGN PATENT DOCUMENTS

| | | | |
|---|---|---|---|
| 43192 | 7/1910 | Austria | 63/28 |
| 597629 | 9/1925 | France | 63/28 |

*Primary Examiner*—F. Barry Shay

*Attorney, Agent, or Firm*—Laff, Whitesel, Conte & Saret

[57] ABSTRACT

An article of jewelry has an appearance of a cluster of gem stones instead of a piece of gold with gem stones mounted on it. First, a group of gem stones is selected according to size, color, and shape. Then the gem stones are arranged in a desired cluster or geometrical pattern. Next, the cluster arrangement is inverted and the pattern of the back of the cluster is traced. Then, a custom frame or crown of prongs is formed for each gem stone and all frames or crowns are welded together into a matrix, in the desirable geometrical arrangement. Each gem stone is set into its own frame or crown and an edge of the frame is molded as a bezel, or prongs are bent, over the sloping edge facet of the gem stone. Either way, the impact of the resulting jewelry is one of a cluster of gem stones and is not one of a piece of gold or other metal with a stone set on it.

4 Claims, 13 Drawing Figures

MEANS FOR AND PROCESSES OF MOUNTING GEM STONE CLUSTERS

This invention relates to means for and processes of mounting precious and semi-precious gem stones, and more particularly, to means for mounting clusters of such gem stones, with a minimum of the metal setting showing.

Precious and semi-precious gem stones are, of course, very expensive and very small items, which are easy to lose, if not securely set. Moreover, each type of gem stone has a beauty of its own which is determined by its light reflecting and refracting characteristic and which requires unique mountings, as compared with the needs of other types of gem stones. Therefore, means for and processes of mounting and displaying any type or combination of types of gem stones must provide security against loss and must conform to the individual gem stone's unique mounting needs for reflecting and refracting light.

The individual optical qualities of transparent gem stones require them to have facets set at angles that collect light internally within the stone and reflect it out through a particular facet, usually a flat surface at the top of the gem stone. The light is so collected by the entire gem stone—not just the top; therefore, the entire gem stone should be exposed to light.

A third consideration is the appearance of a background of gold, silver, or the like, which displays the gem stone. Heretofore, precious and semi-precious gem stones have often been dominated by their mounting and have appeared to be a decoration for a gold setting. This is unfortunate because the beauty of the gem stone is usually much greater than the beauty of the finding or setting, even if it is made of gold.

Because of these and other considerations, it is common practice to first make a finding or setting and then to hunt for a gem stone (such as a diamond) to set therein, which almost inherently causes the diamond or other stone to be secondary to the gold which is displayed between and around the diamond.

Another way of setting stones (sometimes called "channel" work) is to solder or weld one or more, thin, upstanding strips of metal on a metal back plate. Then stones, cut in the outlines established by the strips, are placed on top of the metal back plate and within the frame or frames formed by the strips. The strips are then molded over the edges of the stones to capture and hold them against the back plate. This kind of setting blocks light from reaching any but the exposed surface, thereby effectively limiting conventional channel work to use with opaque or partially opaque stones. Or, alternatively, if used with transparent gem stones, the optical qualities of the gems suffer greatly. Therefore, if a non or semi-transparent stone such as jade is used in combination with a transparent gem stone such as a diamond, the non-or-semi-transparent stone may be set in channel work, but the diamond must be set in a conventional crown of prongs so that its entire surface collects light.

Inherently, these and other constraints force a jewelry designer to limit his creativity when he wishes to display a cluster of transparent gem stones, such as rubies and diamonds.

Accordingly, an object of this invention is to provide new and improved means for and processes of mounting clusters of transparent precious and semi-precious gem stones. Here, an object is to provide new and improved means and processes for first matching a cluster of gem stones and then for mounting them, with a minimum of diversion of viewer attention from the beauty of the cluster to the setting.

Another object of the invention is to provide a flexibility of jewelry design. Here, an object is to provide means for mounting virtually any preselected cluster of precious gem stones in any desirable arrangement, without simultaneously detracting viewer attention from the gem stones to the background of metal.

In keeping with an aspect of the invention, these and other objects are accomplished by first arranging a group or cluster of precut, precious gem stones in any desirable geometrical pattern or arrangement. Next, the cluster arrangement is inverted and the pattern of the back of the cluster is traced. Then, a custom frame or crown of prongs is formed for each gem stone and all frames or crowns are welded together into a matrix in the desirable geometrical arrangement. Each gem stone is set into its own frame or crown and an edge of the frame is molded as a bezel, or prongs are bent, over the sloping edge facet of the gem stone. Either way, the impact of the resulting jewelry is one of a cluster of gem stones and is not one of a piece of gold or other metal with gems set on it.

Preferred embodiments of the invention are seen in the attached drawing wherein:

FIGS. 1A and 1B schematically illustrate the front and back, respectively, of an exemplary finished piece of jewelry (here a pendant) constructed according to the invention;

Figure 1A:
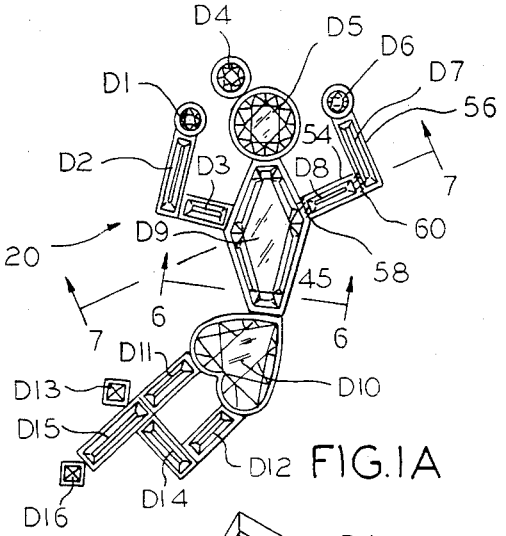
Figure 1B:
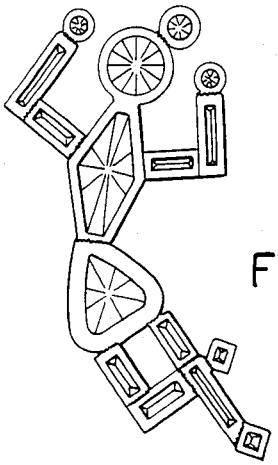
Figure 2:
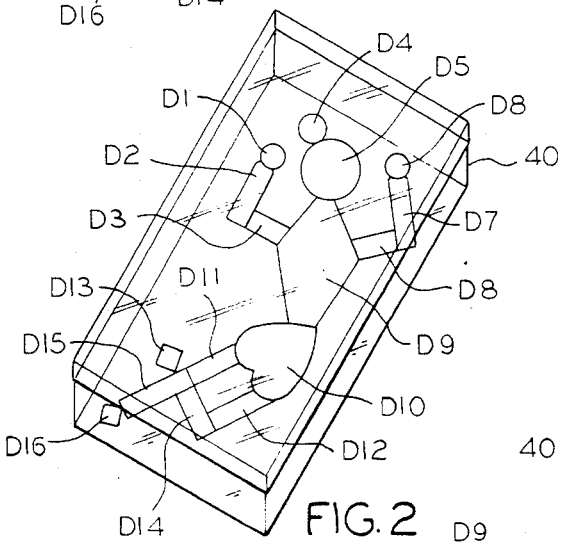
FIG. 2 is a perspective view of a cluster of gem stones laid out in a desired pattern, within a transparent box.
Figure 3:
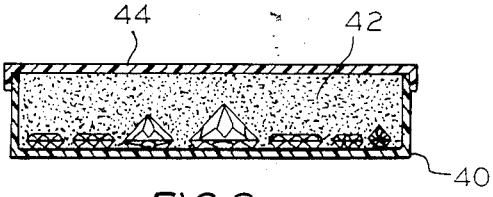
FIG. 3 is a cross-sectional view of the gem cluster of FIG. 2 held in place by a resilient pad compressed over them by a box cover.
Figure 4:
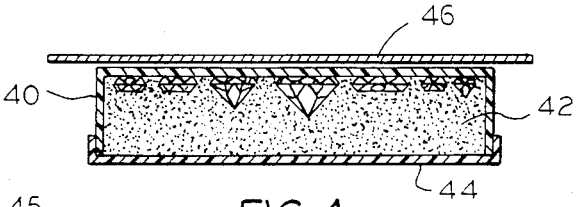
FIG. 4 is a view of the same box after it is inverted so that the gem stones are clearly seen through a transparent bottom, with tracing paper, or the like, in position above the box.

The jewelry of FIG. 1 is here shown as a pendant 20, by way of a non-limiting example only. It could also be a pin, ring, bracelet, earring, or any other suitable device. FIG. 1A shows the front and FIG. 1B shows the back of the same pendant.

The artisian who makes the pendant 20 begins with a collection of cut gem stones D1–D16, which he first selects according to shape and color. The individual gem stones may have any suitable appearance. For example, they may all be blue-white diamonds; or, as here shown, the gem stones forming the two feet D13, D16 may be dark red garnets. Alternatively, the chest could be a different colored diamond, such as blue.

Next he lays them out on a transparent flat surface and arranges them in an attractive cluster or pattern, such as the cluster or pattern of the final product seen in FIG. 1. Obviously, any other suitable arrangement of any suitable number and kind of stones may be selected. From an inspection of FIG. 1, it is seen that this particular geometric arrangement has sixteen gem stones D1–D16 arranged in a somewhat feminine, human form. This same collection of gem stones could have been arranged in any other convenient geometrical cluster or form.

The steps of a preferred process for manufacturing the pendant of FIG. 1 are seen in FIGS. 2–9. A transparent box (FIG. 2) has a flat bottom which is large enough to receive the cluster of loose gems in the desired geometrical lay out. By comparing the final form of FIG. 1 with the lay out of FIG. 2, it is seen that the arrangement is the same.

Next, a resilient pad 42 (FIG. 3) is carefully placed over the cluster of loose stones, without moving any of them. The thickness of pad 42 is such that it is somewhat compressed when a lid 44 is positioned over and closed against the box. This compression exerts a holding force against the gems to keep them in place.

After the lid 44 is secured over the box, it is inverted (FIG. 4), and the gems are clearly visible through the bottom. A suitable sheet of tracing paper 46 is positioned over the box and the outline of the gem cluster is traced. Obviously, other means could also be used, such as photographic or photocopying techniques. In any event, the step of FIG. 4 leads to an outline (FIG. 5) of the final metal setting on paper 46. The outline is in sufficient detail to enable a goldsmith to create the gold (or a similar) setting.

A separate frame (such as 45—FIGS. 6–9) is formed for each gem stone by following the tracing made on paper 46 for each individual stone in the cluster of gem stones in the inverted box. Assuming that the gem stones have a sufficient monetary value (as flawless diamonds have), each frame is most likely to be made of solid gold or platinum. As best seen in FIGS. 6–9, each frame is initially made in the form of a metal channel having an inwardly directed and somewhat tapering lower or bottom edge 48 which provides a seat conforming to the lower sloping facets 50, 50 of the diamond D9. The upper edge 52 is upstanding so that the gem stone D9 may be dropped onto the seat formed by the inwardly, tapering lower edge 48.

Figure 5:
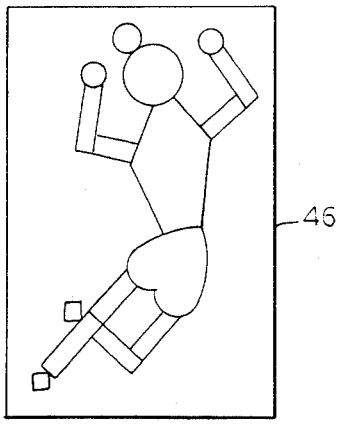
FIG. 5 is a plan view of a pattern of the gem stone cluster formed on the paper during the tracing step of FIG. 4.
Figure 6:
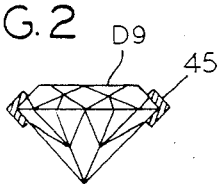
FIG. 6 is a first cross-section of the pendant, taken along line 6—6 of FIG. 1.
Figure 7:
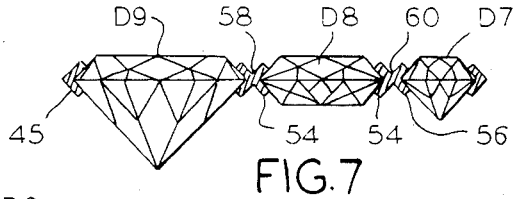
FIG. 7 is a second cross-section of the pendant, taken along line 7—7 of FIG. 1.
Figure 8:
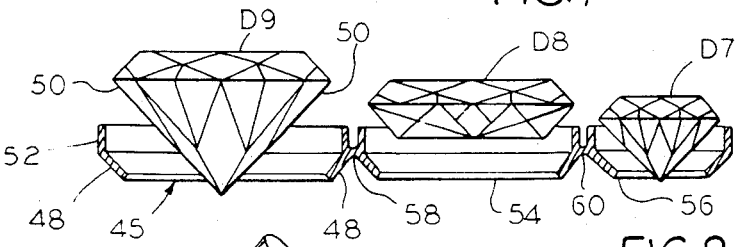
FIG. 8 is a cross-section, also taken along line 7—7, which shows the metal setting or frame for the pendant of FIG. 1 before any gem stones are mounted therein.
Figure 9:
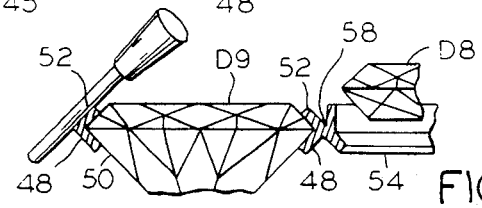
FIG. 9 shows an exemplary gem stone being set in the metal frame of FIG. 8.

In a similar manner, an individual frame is prepared for each of the other sixteen gems of stones D1-D6 which make up the desired cluster. The various frames are then arranged in the form of the selected cluster, as seen in FIG. 1 and in the pattern on the paper 46 (FIG. 5). For example, diamond D8 has frame 54 specifically constructed to exactly fit around the perimeter of its girdle and diamond D7 has frame 56 constructed to exactly fit around the perimeter of its girdle. Different techniques may be used to make the gold frames, such as soldered bands of metal and lost wax mandrel castings, for example.

The individual frames are assembled into a matrix in the selected form (as seen in FIG. 5) and welded or soldered together. For example, short hatch marks are used at 58, 60 in FIG. 1 to show where frames 45, 54, 56 are welded or soldered together. In a similar manner, all of the other frames for each of the gem stones may be added to form the total matrix, seen between the gem stones in FIG. 1.

Regardless of how the individual gold framing is made, each gem stone has its own individual seat and the gold visible between the gems is held to a minimum. Once the complete frame is welded together and in final matrix form, each gem stone is set in its individual frame. A blunt instrument 58 (FIG. 9) is used to mold the upstanding fence (as at 52) into a tightly fitting bezel for holding the gem stone in place.

The advantage of the invention should now be apparent. Usually, the prior art required a design in metal, and then prongs were welded to that metal, at desired locations. Thereafter, gem stones were selected to fit the prongs and to conform to the design. The basic consideration in gem selection was how best to set off the design already frozen in metal. According to the invention, compatible stones are selected according to any of a number of criteria such as color, size, style of cut, etc. Then, the stones are arranged into a cluster which provides the final appearance and enables the various stones to complement each other. For example, one could imagine a simple color burst where a central blue white stone is surrounded by pale yellow stones, and they in turn, are surrounded by deeper gold stones, etc. This is not to say that every frame necessarily has to have a gem stone in it. Quite the contrary, sometimes there might be a special reason for doing otherwise. To illustrate, the stone D4 could be replaced by a gold hat. Other times, there could, for example, be a tradition to replace a stone with a gold filled empty frame to represent a fallen tear. Thus, the invention allows room for special effects.

Figure 10:
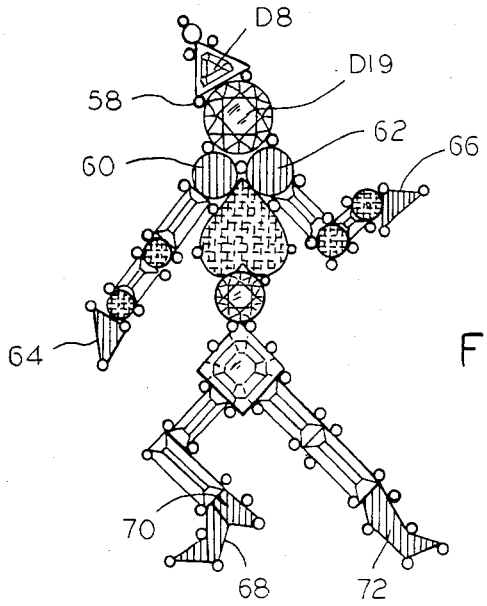
FIG. 10 shows an alternative form of a frame having crowns of prongs for displaying spots of gold between the gem stones.

FIG. 10 shows another use of gold in a matrix, to further minimize the amount of metal appearing between the gems. Here, the visible gold is restricted to prongs and preferably to prongs having heads which are somewhat similar to the head of a common straight pin. The only things visible from the front of the jewelry are the cluster of gems and small gold "dots" sprinkled in among the gems where the prongs are seen. Color is exemplified in FIG. 10 by placing red rubies at 60, 62 to form a red bow-tie. The hands 64, 66, and feet 68, 70, 72 are dark red garnets. The chest is a yellow, heart shaped diamond. The remainder of the gems are blue white diamonds.

Figure 11:
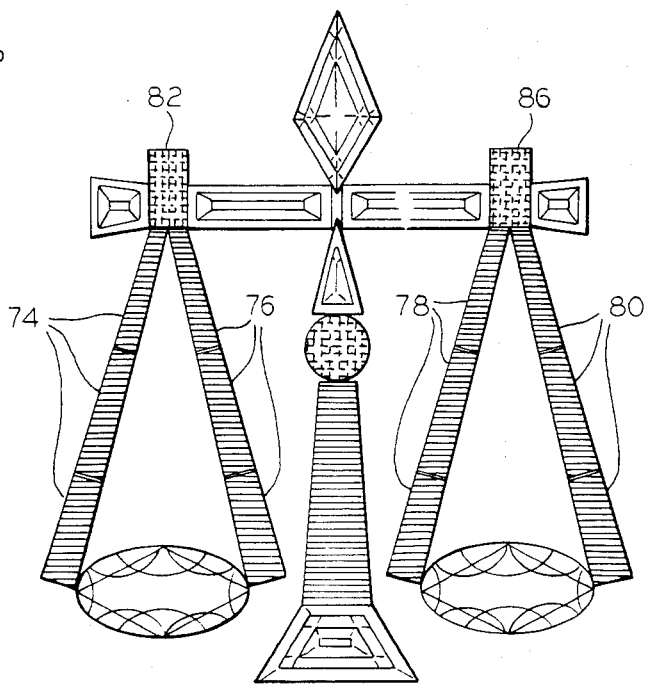
FIG. 11 shows an unmounted gem stone cluster, in a different format.

FIG. 11 shows a cluster of gems to indicate how the invention may be used to provide different forms of geometric designs. Here, a scale of justice is made primarily from blue white diamonds with blue diamonds used at 74, 76, 78, 80 to form the rods of the "pans", and yellow diamonds are used at pivot points 82, 84, 86.

Figure 12:
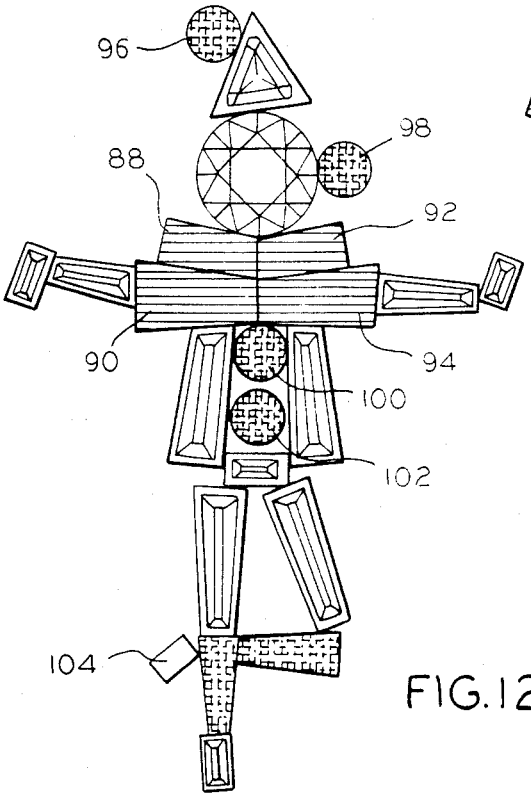
FIG. 12 shows an exemplary use of color in the gem stone cluster.

FIG. 12 shows a further sophistication by yet another cluster of gems using color to achieve special effects. Here, a clown has a blue bow tie formed by gems 88, 90, 92, 94. The clown hat has two tassels 96, 98 of dark yellow gems, and the jacket has light yellow buttons 100, 102. The remainder of the gems are all blue white diamonds. Here, the foot 104 is shown by way of example as a piece of gold to illustrate how variety may be given to an otherwise purely gem stone collection.

A principle of the invention should now be clear. The gems are arranged in a geometrical pattern which is preferably suggestive of a familiar form or figure. A setting frame or crown of prongs is made for each of the gems and the settings are welded together into a matrix so that a minimum amount of gold is seen from the front. Colored gems are used where necessary to further enhance the "realism" of the design and to provide artistry of gemonology.

Those who are skilled in the art will readily perceive how to modify the system. Therefore, the appended claims are to be construed to cover all equivalent structures which fall within the true scope and spirit of the invention.

We claim:

1. A process of making jewelry comprising the steps of:

(a) selecting a group of gem stones according to size, shape, and color;

(b) arranging said selected group of gem stones in a desired geometrical pattern or cluster arrangement and laying out the arrangement of gem stones on a transparent surface;

(c) inverting the gem stone arrangement and transparent surface, and forming a pattern by tracing the inverted gem stone arrangement through said transparent surface thereby forming a pattern from the cluster arrangement;

(d) custom forming an individual setting for each gem stone in said group;

(e) welding together said individual settings in the desirable geometrical pattern or arrangement; and (f) setting said gem stones into substantially all settings, each stone being set in its own individual setting; whereby the impact of the resulting jewelry is one of a cluster of gem stones and is not one of a piece of gold or other metal with gem stones set on it.

2. The process of claim 1 wherein said transparent surface is the bottom of a box, and the added step of compressing a resilient pad within said box for holding said gem stones in place when said inversion occurs.

3. The process of claim 1 wherein said desired pattern is a suggestive replica of a known form.

4. A product made by the process of any one of the claims 1, 2, or 3.

* * * * *